United States Patent [19]

Pranaitis

[11] 4,363,353

[45] Dec. 14, 1982

[54] EXHAUST PIPE HEAT EXCHANGER

[76] Inventor: Ronald B. Pranaitis, 2525 E. 223rd St., Sayk Village, Ill. 60411

[21] Appl. No.: 176,779

[22] Filed: Aug. 8, 1980

[51] Int. Cl.[3] ..... F28D 7/02

[52] U.S. Cl. ..... 165/39; 165/128; 165/DIG. 2; 165/DIG. 13; 237/55

[58] Field of Search ..... 165/39, 128, DIG. 2, 165/DIG. 12, 164, 179, DIG. 13; 237/55; 126/248

[56] References Cited

U.S. PATENT DOCUMENTS

| | | | |
|---|---|---|---|
| 33,849 | 12/1861 | Oakeley | 165/128 |
| 195,320 | 9/1877 | Winchell | 165/128 |
| 551,489 | 12/1895 | Fox | 165/128 |
| 609,935 | 8/1898 | Holland | 165/128 |
| 798,183 | 8/1905 | Holt et al. | 165/128 |
| 1,060,415 | 4/1913 | Ayres | 237/55 |
| 2,343,542 | 3/1944 | Faunce | 165/DIG. 2 |
| 2,882,023 | 4/1959 | Rizzo | 165/DIG. 2 |
| 2,902,265 | 9/1959 | Dubovick | 165/DIG. 2 |
| 3,884,292 | 5/1975 | Pessolano et al. | 165/39 |
| 3,987,761 | 10/1976 | Downs et al. | 122/20 B |
| 4,103,735 | 8/1978 | Warner | 165/39 |
| 4,235,286 | 11/1980 | Behlau | 165/164 |

*Primary Examiner*—Samuel Scott
*Assistant Examiner*—Margaret A. Focarino
*Attorney, Agent, or Firm*—Harvey B. Jacobson

[57] ABSTRACT

One exchanger unit comprises a length of exhaust pipe tube having a plurality of smaller heat exchange tubes which extend diametrically through the exhaust pipe tube. Each of the heat exchange tubes is canted slightly longitudinally of the exhaust pipe tube and the heat exchange tubes are disposed in a helical configuration to force the exhaust gases to swirl through the exhaust pipe tube. The heat exchanger units can be disposed in a furnace exhaust pipe or can be arranged between inlet and outlet plenums which are connected in a furnace exhaust pipe or the like.

15 Claims, 11 Drawing Figures

EXHAUST PIPE HEAT EXCHANGER

BACKGROUND OF THE INVENTION

1. Field of the Invention

This invention relates to heat exchangers and especially to heat exchangers adapted for recovering waste heat from furnaces, hot water heaters or the like.

2. Discussion of Related Art

It has been known for many years to attempt to recapture waste heat from the exhaust pipe or flue of an existing stove, furnace or the like. For instance, U.S. Pat. No. 1,060,415, issued Apr. 29, 1913 to Ayres shows a flue having a deflector disposed therein for channeling exhaust gases to a heat exchanger drum. Transverse radiator pipes extend through the drum for heating air passing through the pipes. U.S. Pat. No. 2,189,749, issued Feb. 13, 1940 to Windheim et al, shows a waste heating system including a water heating unit having spaced inner and outer casings, the space between the casings constituting a flue passage. Vertical flue tubes extend the length of the inner casing and a water wheel is contained within the inner casing and a water coil is contained within the inner casing and surrounds the flue tubes. The exhaust gases from a conventional furnace are channeled through the vertical flue tubes. U.S. Pat. No. 2,343,542, issued Mar. 7, 1944 to Faunce, shows a heat exchanger for connection in a pipe leading from a heating system. The heat exchanger has a lower casing with an open top and an upper casing disposed on the lower casing. Tubes extend through and are sealed to the ends of the upper casing. A tapered hood connects the intake end of the upper casing with an exit from a furnace. Other patents showing similar heat exchanger structure include U.S. Pat. No. 2,920,265, issued Sept. 1, 1959 to Dubovick, U.S. Pat. No. 2,882,023, issued Apr. 14, 1959 to Rizzo, and U.S. Pat. No. 4,103,735, issued Aug. 1, 1978 to Warner. Even though there are numerous heat exchanger structures which are useful, there exists a constant need for such structures which are more efficient, less costly, and easier to install and use.

SUMMARY OF THE INVENTION

One object of the present invention is to provide an exhaust pipe heat exchanger which can easily be connected to an existing exhaust pipe or flue of a hot water heater, furnace or the like.

An additional further object of the present invention is to provide an exhaust pipe heat exchanger which promotes prolonged contact between exhaust gases and the heat exchanger tubes to insure high efficiency of the heat exchanger.

A further object of the present invention is to provide an exhaust pipe heat exchanger wherein the placement of the heat exchanger tubes is such as to promote ambient air flow therethrough in the absence of forced air movement.

An even still further object of the present invention is to provide an exhaust pipe heat exchanger comprising a plurality of heat exchanger units which can be used individually or collectively mounted between input and output plenums with the entire combined structure being disposed in an exhaust pipe or flue.

Yet another object of the present invention is to provide an exhaust pipe heat exchanger which is adapted for use with a forced air circulation device such as a fan or which can be used without such a device.

In accordance with the above objectives, the heat exchanger of the present invention comprises a plurality of exchanger units each of which is formed from a length of standardly available aluminum exhaust pipe tubing of a diameter slightly larger than the diameter of the exhaust pipe to which it is to be attached. A plurality of heat exchanger tubes having a diameter significantly less than that of the exhaust pipe tubes are disposed transversely through the exhaust pipe tube, preferably diametrically thereof. The heat exchanger tubes are spaced longitudinally of the exhaust pipe tube and adjacent heat exchanger tubes being offset slightly from each other in a helical pattern. In this manner, when exhaust gases are forced through the exhaust pipe tube, the gases contact each of the heat exchanger tubes individually and are forced through a spiral pattern in the exhaust pipe tube thus prolonging contact of the gases and heat exchanger tubes. Further, each of the heat exchanger tubes is canted slightly longitudinally on the exhaust pipe tube. In this manner, when the unit is disposed in a vertical orientation, ambient air flow through the canted tubes will be promoted by natural forces.

Further, a plurality of the tubes can be disposed between common inlet and outlet plenums with each of the plenums having elongated exhaust pipe tubes disposed transversely thereof to provide further heat exchange capability. Upper and lower walls are connected between the plenums and can be used to mount a fan for causing forced air circulation through the heat exchanger tubes of the individual units.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 7:
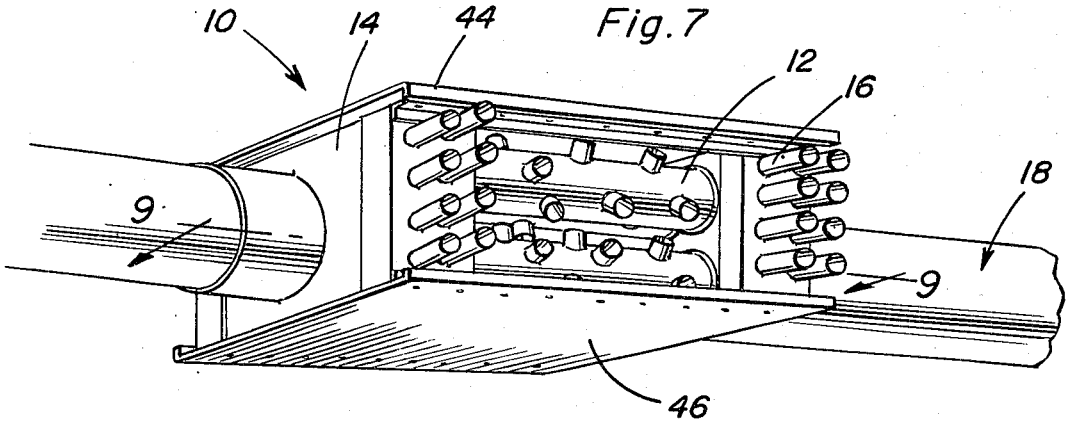
FIG. 7 is a perspective view showing a heat exchanger of the invention incorporating a plurality of units between common plenums.
Figure 8:
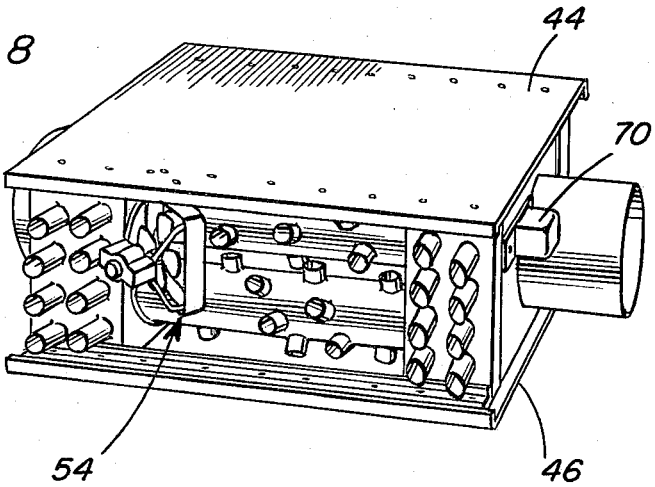
FIG. 8 is a perspective view of the heat exchanger of FIG. 7 showing a fan mounted therein.
Figure 9:
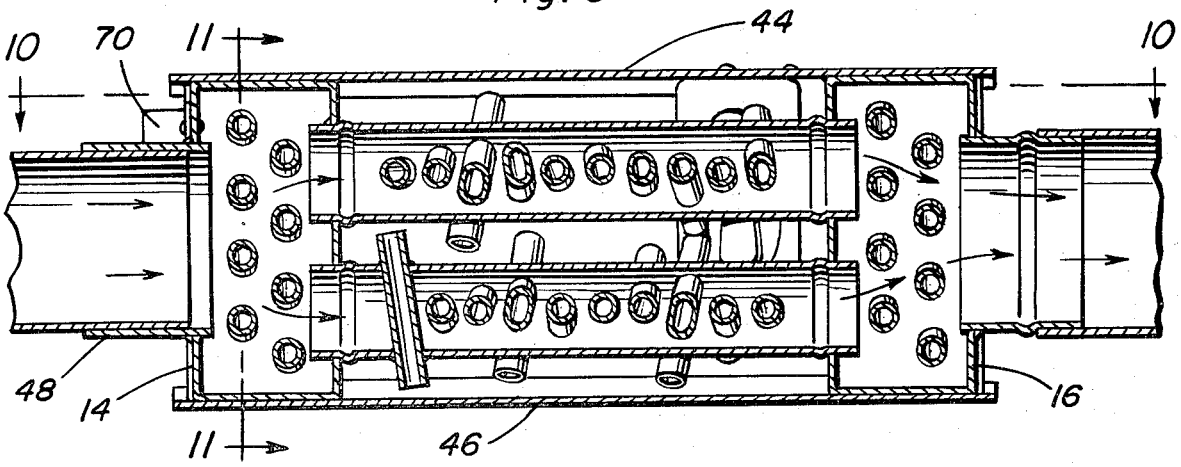
FIG. 9 is a longitudinal sectional view taken substantially along a plane passing through section line 9—9 of FIG. 7.

Now with reference to the drawings, an exhaust pipe heat exchanger incorporating the principles and concepts of the present invention will be described in detail. With particular reference to FIG. 7, it can be seen that the exhaust pipe heat exchanger 10 comprises a plurality of heat exchanger units 12 which extend longitudinally between inlet plenum 14 and outlet plenum 16 and are aligned with the exhaust line 18 connected to a standard furnace or the like.

Figure 1:
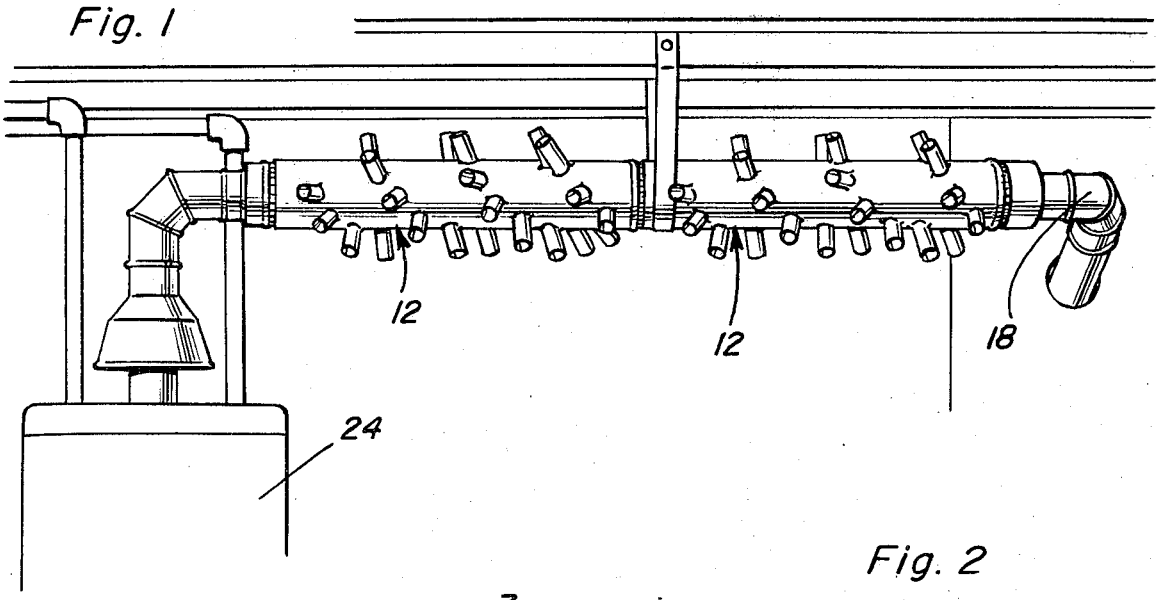
FIG. 1 is a perspective view of two heat exchanger units disposed in a furnace exhaust pipe line.
Figure 2:
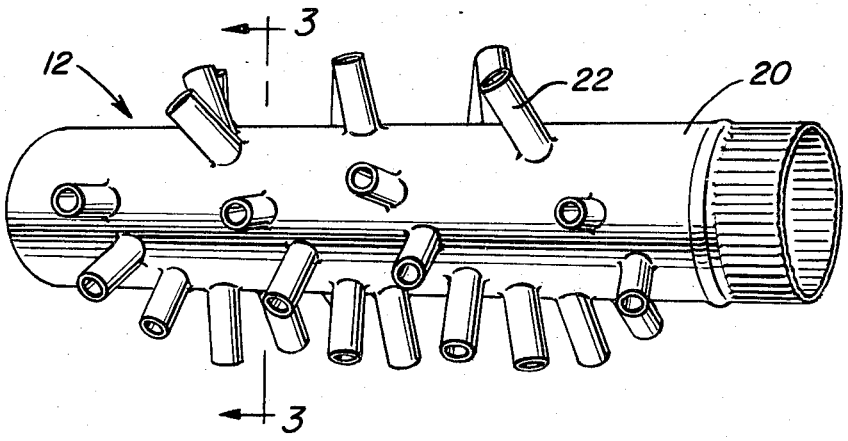
FIG. 2 is a perspective view of one heat exchanger unit of the invention.
Figure 3:
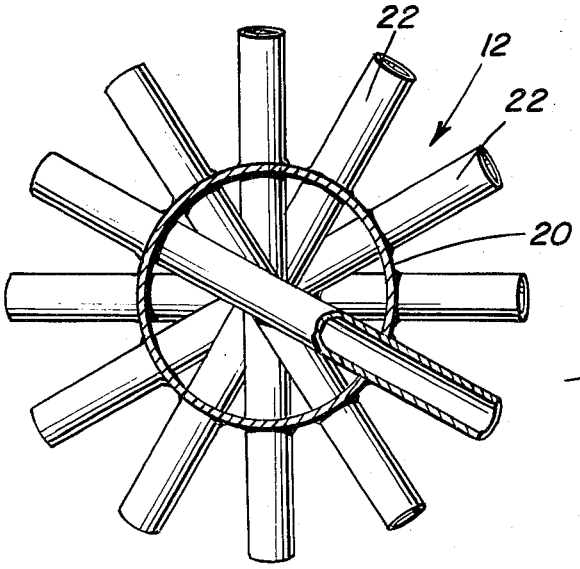
FIG. 3 is a transverse sectional view taken substantially along the plane passing through section line 3—3 of FIG. 2.
Figure 4:
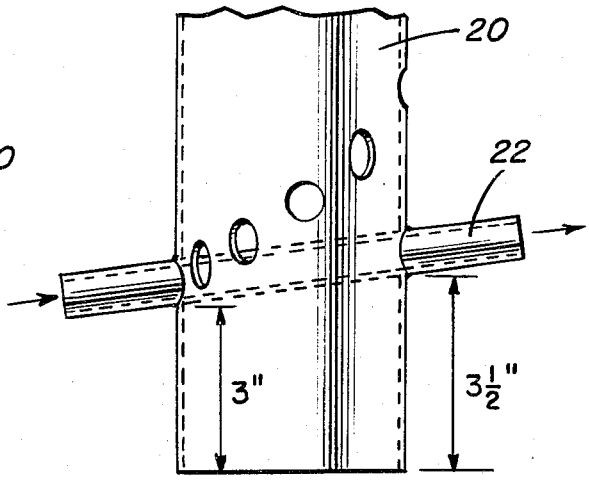
FIG. 4 is a fragmental view of one heat exchanger unit showing the canting of one of the heat exchanger tubes.

With respect to FIGS. 2–6, it can be seen that one heat exchanger unit 12 comprises a length of exhaust pipe tubing 20 which preferably is produced from aluminum or other high heat conductive material. A plurality of smaller heat exchange tubes 22 are disposed through the exhaust pipe tubing 20 transversely thereof. Preferably, each heat exchange tube 22 extends diametrically through the tube 20 in order that a maximum area of each tube 22 is exposed to the flow of exhaust gases. Tubes 22 should also be formed from aluminum or other high heat conductivity material in order to improve the efficiency of the overall device. As shown in FIG. 4, each of the tubes 22 is canted longitudinally of the tube 20 by a slight amount. As shown, the lower end of tube 22 of FIG. 4 is approximately ½ inch below the upper end of tube 22 at the point of contact of each end with tube 20. Each unit 12 can be oriented either horizontally or vertically. When oriented horizontally, air flow is promoted through heat exchange tubes 22 by natural forces when the air within the tubes is heated. When the tube 20 is oriented vertically, the canted orientation of tubes 22 serves to promote air flow therethrough also by natural forces. Thus, the use of a fan to force air through the tubes is not absolutely necessary.

Heat exchange tubes 22 are disposed in an offset roll from one end of tube 22 to the other. Adjacent heat exchange tubes 22 are offset by equal amounts so the protruding ends of the tubes are disposed in a helix about tube 20. In this manner, when exhaust gases are forced through the exhaust pipe 20, the hot gases contact each of the heat exchange tubes 22 equally. Further, the orientation of the heat exchange tubes is such that the exhaust gases are forced to follow a spiral path from one end of exhaust tube 20 to the other, thus prolonging the duration of contact with the heat exchange tubes thereby increasing the efficiency of the unit.

Figure 5:
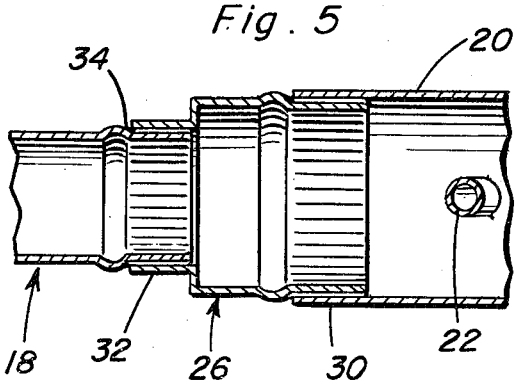
FIG. 5 is an elevational sectional view showing the connection of the left end of a heat exchanger unit with an exhaust pipe line.
Figure 6:
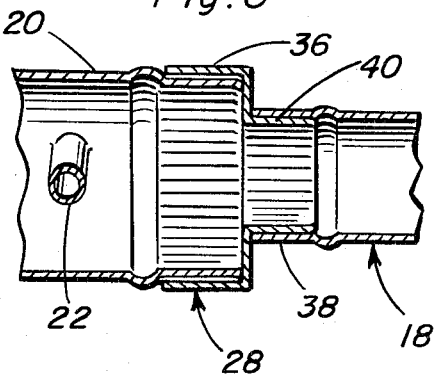
FIG. 6 is an elevational sectional view showing the connection of the right-hand end of a heat exchanger unit in an exhaust pipe line.

Obviously, the units 12 can be used individually and connected in the exhaust line 18 of a furance 24 or the like for heating the air in a basement or utility room. As mentioned above, the unit 12 can be disposed directly in the line whether it runs horizontally or vertically. In order to insure a non-restricted flow of the exhaust gases through line 18, the diameter of the heat exchange tube 20 should be larger than that of the exhaust line 18 in order to compensate for the area occupied by the heat exchange tubes 22. The units 12 are then inserted in the line 18 by the use of adaptors 26 and 28 as shown in FIGS. 5 and 6. Adaptor 26 has a reduced larger end 30 which fits within the inlet end of tube 20 and an inlet end 32 which fits over reduced outlet end 34 of the previous section of tubing in line 18. The outlet end of tube 20 is reduced and fits within the inlet end 36 of adaptor 28. The outlet of adaptor 28 shown at 38 fits within the inlet 40 of the following section of line 18. Adaptors 26 and 28 are standardly available items which facilitate the insertion of heat exchanger units 12 into the exhaust line 18.

Figure 10:
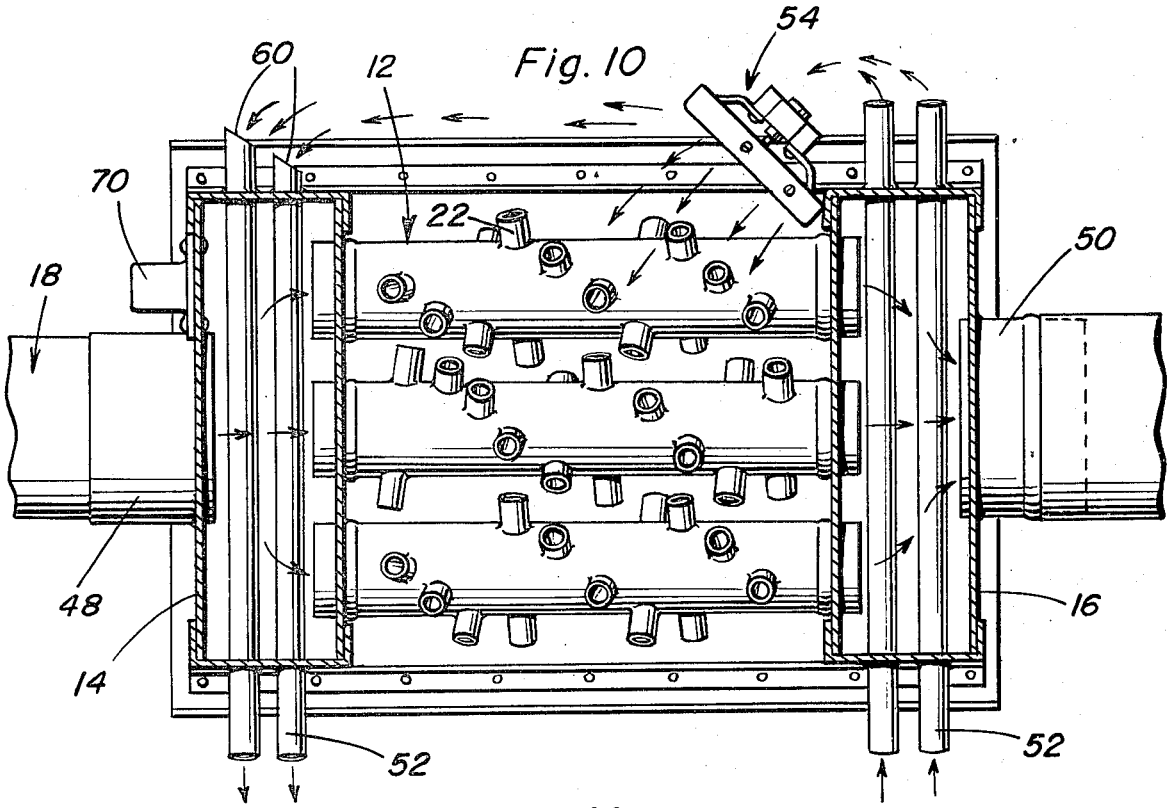
FIG. 10 is a plan sectional view taken substantially along a plane passing through section line 10—10 of FIG. 9.
Figure 11:
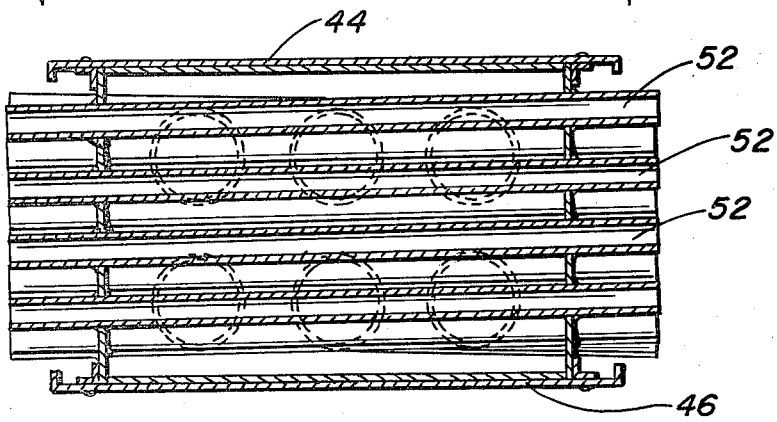
FIG. 11 is a transverse sectional view taken substantially along the plane passing through section line 11—11 of FIG. 9.

If greater heat exchange capability is desired, the heat exchanger 10 shown in FIGS. 7–11 can be used. As discussed above, heat exchanger 10 comprises a plurality of units 12 which extend between plenums 14 and 16. The plenums are rectangular in shape and formed from aluminum. They are held in fixed relation to each other by top and bottom plates 44 and 46 respectively. Each of the heat exchanger units 12 extends between aligned openings in the plenums 14 and 16 and is fixedly secured in these openings. Obviously, exhaust gases from line 18 enter inlet 48 of plenum 14. The gases are distributed among the units 12 disposed therein and pass through the units and out plenum 16 through outlet 50. Additionally, heat exchange tubes 52 are disposed transversely of the plenums 14 and 16 to increase the efficiency of the heat exchanger. As shown in FIG. 11, the heat exchange tubes 52 are disposed at an angle in order to promote ambient air flow therethrough as discussed in relation to tubes 22.

In order to further increase the efficiency of the heat exchanger, a fan 54 can be mounted on the upper wall 44 and disposed at an angular orientation such that air will be drawn from tubes 52 in the plenum 16 and forced through tubes 22 of units 12 and tubes 52 of plenum 14 as depicted in FIG. 10. It will also be noted that tubes 52 of the plenum 14 have bevelled ends 60 to catch the oncoming air from fan 54 and channel it through the tubes. Control of the fan 54 operation can be effected by use of a thermostat 70 which is attached to the end wall of plenum 14 so that the fan will not operate when no hot exhaust is present.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A heat exchange unit for connection in the exhaust line of a fuel burning apparatus comprising: an elongated tubing section having an inlet end and an outlet end; a plurality of exchange tubes disposed between an inlet plenum and an outlet plenum, each of said exchange tubes being further disposed transversely through said elongated tubing section with said exchange tubes, being spaced longitudinally of said tubing section, and further wherein adjacent ones of said exchange tubes are offset with the ends of said exchange tubes being disposed in a helical conformation longitudinally of the tubing section, and second heat exchange tubes being disposed transversely of each of said inlet and outlet plenums.

2. The invention as defined in claim 1 wherein said elongated tubing section is cylindrical and each of said exchange tubes passes substantially diametrically therethrough.

3. The invention as defined in claim 1 wherein said each of said exchange tubes is canted slightly longitudinally of said elongated tubing section.

4. The invention as defined in claim 1 wherein said exhaust line of a fuel burning apparatus comprises tubing having a diameter less than the diameter of said elongated tubing section.

5. The invention as defined in claim 1 wherein said elongated tubing section and said exchange tubes are produced from aluminum.

6. The invention as defined in claim 1 and further including a fan means operatively associated with said inlet and outlet plenums for forcing air through said heat exchange units.

7. The invention as defined in claim 6 and further including a thermostat means operatively engaging one of said inlet and outlet plenums for controlling operation of said fan means based on the temperature of exhaust gas in said plenum.

8. The invention as defined in claim 7 and further including a pair of walls extending between said inlet and outlet plenums on opposite sides of said plenums.

9. The invention as defined in claim 1 and further including a thermostat means operatively engaging one of said inlet and outlet plenums for controlling operation of fan means based on the temperature of exhaust gas in said one plenum.

10. The invention as defined in claim 1 and further including a pair of walls extending between said inlet plenum and said outlet plenum and extending on opposite sides of said inlet plenum and said outlet plenum.

11. The invention as defined in claim 1 wherein said elongated tubing section is cylindrical and each of said exchange tubes passes substantially diametrically therethrough.

12. The invention as defined in claim 1 wherein said each of said exchange tubes is canted slightly longitudinally of said elongated tubing section.

13. A heat exchanger for transferring heat from exhaust gases to ambient air within a room, comprising: an inlet plenum having an exhaust gas inlet; an outlet plenum having an exhaust gas outlet; a plurality of heat exchange units disposed between said inlet plenum and said outlet plenum; a plurality of first exchange tubes passing transversely through at least one of said inlet plenum and outlet plenum; and a plurality of second exchange tubes passing transversely through each of said heat exchange units, adjacent ones of said second heat exchange tubes being spaced in a helical conformation on each of said heat exchange units.

14. The invention as defined in claim 13 wherein said second heat exchange tubes pass diametrically through the associated heat exchange units.

15. The invention as defined in claim 14 wherein fan means is disposed adjacent one of said plenums and angularly oriented with respect thereto for drawing air from ones of said first heat exchange tubes and forcing air through other of said heat exchange tubes.

* * * * *